US007329154B2

(12) United States Patent
Koyama

(10) Patent No.: US 7,329,154 B2
(45) Date of Patent: Feb. 12, 2008

(54) ELECTRICAL CONNECTOR HAVING TERMINALS ARRANGED WITH NARROW PITCH

(75) Inventor: Ryozo Koyama, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 11/606,223

(22) Filed: Nov. 30, 2006

(65) Prior Publication Data

US 2007/0141890 A1 Jun. 21, 2007

(30) Foreign Application Priority Data

Dec. 20, 2005 (JP) ..... 2005-366906

(51) Int. Cl.
*H01R 24/00* (2006.01)

(52) U.S. Cl. ..... 439/660; 439/941; 439/353

(58) Field of Classification Search ..... 439/660, 439/941, 862, 353, 357, 857
See application file for complete search history.

(56) References Cited

U.S. PATENT DOCUMENTS 6,106,338 A * 8/2000 Wu et al. ..... 439/660
2005/0014418 A1* 1/2005 Ji et al. ..... 439/660

FOREIGN PATENT DOCUMENTS

JP 5-159831 6/1993
JP 11-312560 11/1999

OTHER PUBLICATIONS

European Search Report, Apr. 5, 2007.

* cited by examiner

*Primary Examiner*—Tulsidas C. Patel
(74) *Attorney, Agent, or Firm*—Takeuchi & Kubotera, LLP

(57) ABSTRACT

An electrical connector includes a housing and a plurality of terminals having a plate shape to be attached to the housing in parallel with a narrow pitch. The plurality of the terminals has holes at opposing portions thereof in a pitch direction such that opposing areas between adjacent terminals is reduced. The housing has a groove bridging over the plurality of the terminals in the pitch direction such that a space is formed between the adjacent terminals.

13 Claims, 10 Drawing Sheets

ELECTRICAL CONNECTOR HAVING TERMINALS ARRANGED WITH NARROW PITCH

BACKGROUND OF THE INVENTION AND RELATED ART STATEMENT

The disclosure of Japanese Patent Application No. 2005-366906, filed on Dec. 20, 2005, incorporated in the application.

The present invention relates to an electrical connector. More specifically, the present invention relates to an electrical connector having a plurality of terminals arranged in parallel with a narrow pitch.

For example, in the fields of mobile phones, digital cameras, PDA, and the likes, reduction in a device size has been rapidly proceeding. Accompanying with this trend, requirement for reduction in a size of electrical connectors used for these devices has been increased. To reduce a size of an electrical connector, for example, when a plurality of terminals is arranged in parallel for use, narrowing a terminal pitch is generally tried. When the terminal pitch is narrowed, there may a case that the terminals arranged with a constant pitch function as if capacitors. As a result, cross talk easily occurs, and it is difficult to transmit signals at a high speed.

To solve this problem, conventionally, as disclosed in Japanese Patent Publications No. 11-312560 and No. 05-159831, holes are provided near center portions of terminals arranged in parallel. An example disclosed in the former Patent Reference is shown in FIG. 19. By providing such a hole 123, opposing areas between adjacent terminals are reduced, thereby reducing capacitance generated between the terminals. Accordingly, it is possible to reduce cross talk between the terminals. The latter Patent Reference discloses technology in which a space is provided between adjacent terminals to reduce a dielectric constant between the terminals, thereby reducing cross talk between the terminals.

[Patent Reference 1] Japanese Patent Publication No. 11-312560

[Patent Reference 2] Japanese Patent Publication No. 05-159831

However, in Japanese Patent Publication No. 11-312560, as shown in FIG. 19, a so-called two point contact type connector is used, in which two contact portions 122 are disposed up and down at positions for sandwiching a mating connector to be connected between themselves to contact with a mating terminal at two points. As a result, a device size increases. In Japanese Patent Publication No. 05-159831, a terminal having a straight portion with a U character shape section perpendicular to a longitudinal direction is used, thereby increasing a device size.

The present invention is to solve the problems in the conventional art. While a so-called one point contact type connector contacting with a mating terminal at one point is used to reduce a device size, problems characteristic to the one point contact type connector such as a strength problem and an elasticity problem are solved.

Further objects will be apparent from the following description of the invention.

SUMMARY OF THE INVENTION

According to an embodiment of the present invention, an electrical connector comprises a housing and a plurality of terminals having a plate shape to be attached to the housing in parallel with a narrow pitch. The plurality of the terminals has holes at opposing portions thereof in a pitch direction such that opposing areas between adjacent terminals are reduced. The housing has a groove bridging over the plurality of the terminals in the pitch direction such that a space is formed between the adjacent terminals.

According to the present invention, in the electrical connector, the holes provided in the plurality of the terminals and the space provided in the housing may be arranged at a same height position in the pitch direction.

According to the present invention, in the electrical connector, each of the plurality of the terminals may have a plurality of holes.

According to the present invention, in the electrical connector, the plurality of the holes provided in each of the plurality of the terminals may be arranged substantially in one row along an attachment direction of the plurality of the terminals relative to the housing.

According to the present invention, in the electrical connector, contact portions capable of contacting with contact portions of mating terminals may be provided at distal ends of the plurality of the terminals, and the contact portions may be positioned along an arrangement direction of the holes of the plurality of the holes.

According to the present invention, in the electrical connector, a column portion may be disposed between the holes, and means for fitting and fixing the plurality of the terminals to the housing may be disposed at a base portion of the column portion.

According to the present invention, in the electrical connector, the housing may have a terminal supporting member protruding toward the mating terminals for arranging the plurality of the terminals. Each of the plurality of the terminals may have a fixing portion to be fitted in and fixed to inside the housing, and a contact piece arranged on an upper surface of the terminal supporting member along a protruding direction in a state that a substantially half thereof is exposed. The contact piece of each of the plurality of the terminals may be arranged to have elasticity in a state that the contact piece lifts a little from the terminal supporting member. Further, the terminal supporting member may have a plate shape.

According to the present invention, in the electrical connector using the one point contact type connector, while the stroke problem is effectively solved, the device size can be reduced.

DETAILED DESCRIPTION OF PREFERRED EMBODIMENTS

Hereunder, embodiments of the present invention will be explained with reference to the accompanying drawings.

Figure 1:
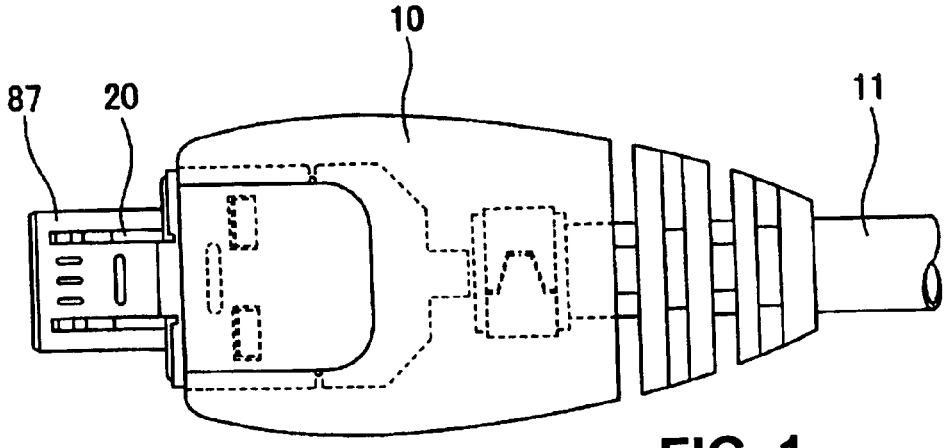
FIG. 1 is a plan view of an electrical connector according to an embodiment of the present invention.
Figure 2:
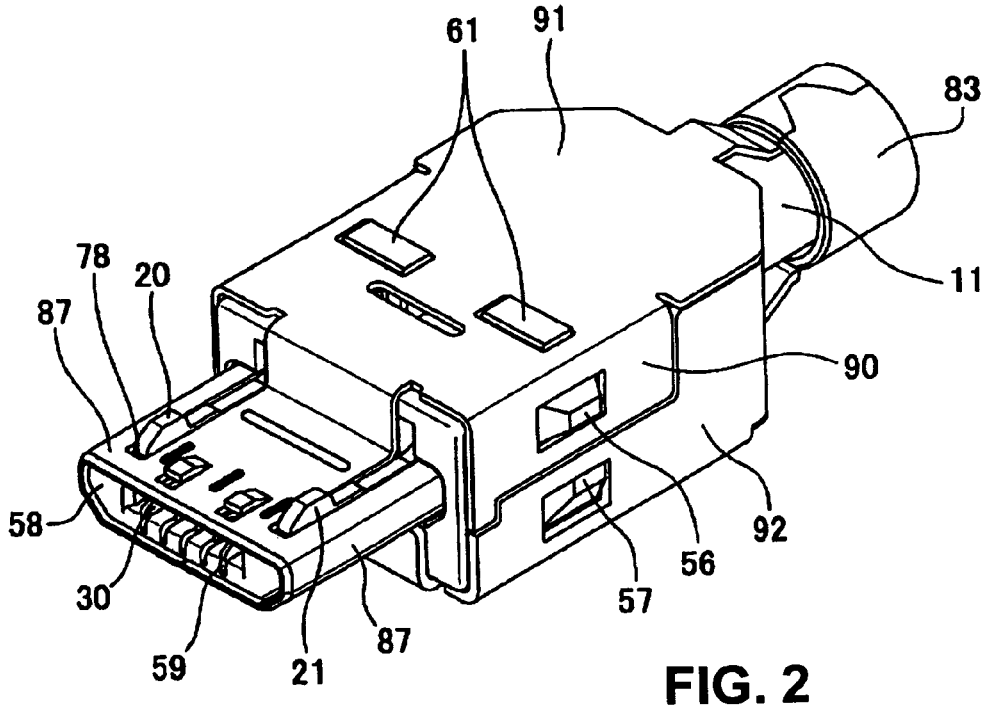
FIG. 2 is a perspective view of the electrical connector before over mold.
Figure 3:
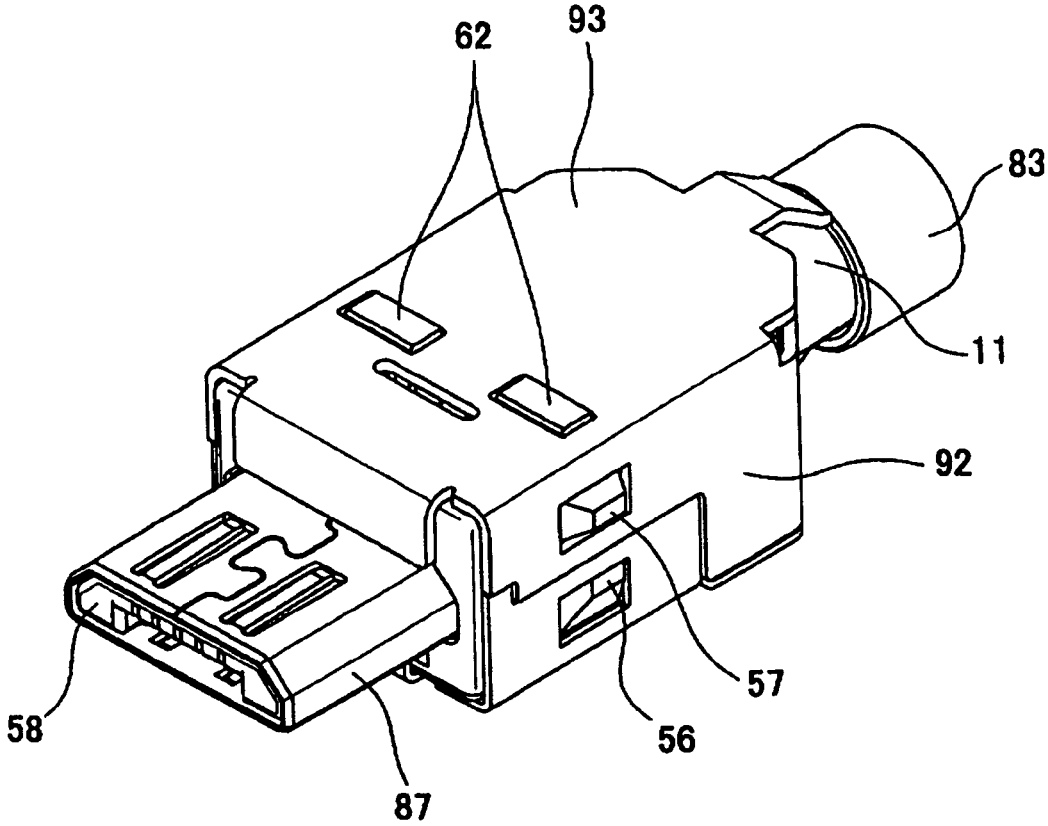
FIG. 3 is a perspective view of the electrical connector before over mold.
Figure 4:
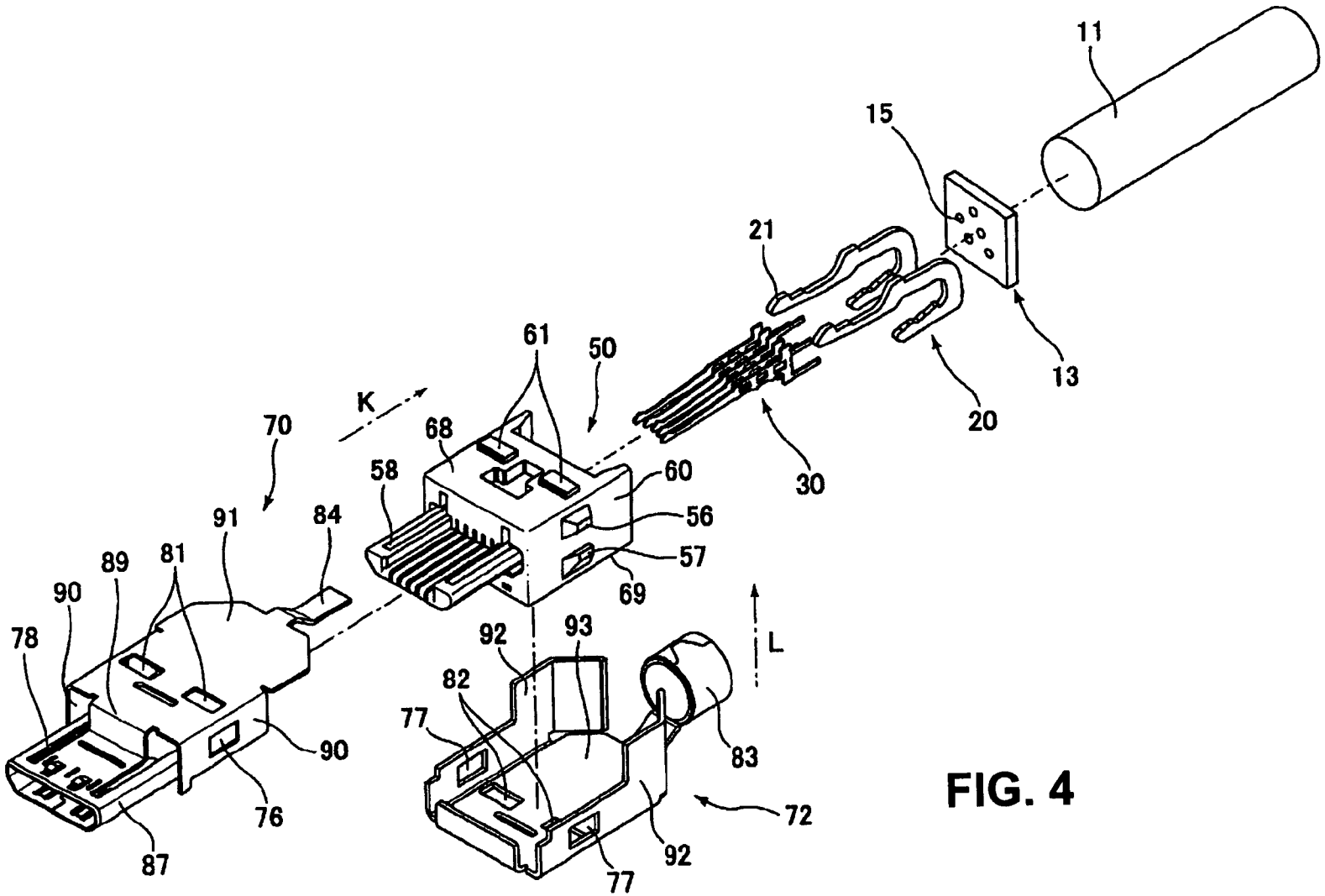
FIG. 4 is an exploded perspective view of the electrical connector before over mold.

In FIG. 1, a plane view of an electrical connector 1 according to the present invention is shown. In FIGS. 2 and 3, an upper perspective view and a lower perspective view of the electrical connector 1 before over mold are shown, respectively. Further, in FIG. 4, an exploded perspective view of the electrical connector 1 before over mold is shown.

As apparent from FIG. 18 (described later), the electrical connector 1 is used as a so-called plug side connector. In an actual use, the electrical connector 1 is detachably fitted into a receptacle side connector (mating connector) 2 disposed on a substrate 101.

The electrical connector 1 mainly includes a housing 50 integrally formed of a resin and the likes; a first shell 70 (first cover portion) and a second shell 72 (second cover portion) used as a cover of the housing 50; terminals 30 with a plate shape arranged in parallel in a longitudinal direction with a narrow pitch such as, for example, 0.4 mm interval; latch members 20 arranged in parallel together with the terminals 30 at positions sandwiching the terminals 30 from left and right sides for locking the electrical connector 1 and the receptacle side connector 2; and a print circuit board (PCB) 13 for covering a rear portion of the housing 50 to prevent the latch members 20 and the terminals 30 from coming off.

The components other than the second shell 72 can be assembled mutually in a substantially straight arrangement direction indicated by an arrow K in the drawing. First, the terminals 30 and the latch members 20 are fitted into the housing 50. Then, lead fixing portions 39 of the terminals 30 pass through lead holes 15 of the print circuit board 13 to protrude from the print circuit board 13. Leads (not shown) of a cable 11 are fixed to the lead fixing portions 39 thus protruded with solder and the likes.

After the assembling operation, the first shell 70 is attached, and the second shell 72 is attached from an arrow direction L (when the second shell 72 is attached, a tight-fitting portion 83 is in an open state, not in a closed state (tube shape) shown in the drawing). Lastly, the tight-fitting portion 83 in the open state is tightly fitted to a circumference of the cable 11 together with a plate portion 84. Note that the print circuit board 13 is not necessarily provided as described above. When the print circuit board 13 is not used, the leads of the cable 11 are directly fixed to the lead fixing portions 39 of the terminals 30 with solder and the likes.

Figure 5:
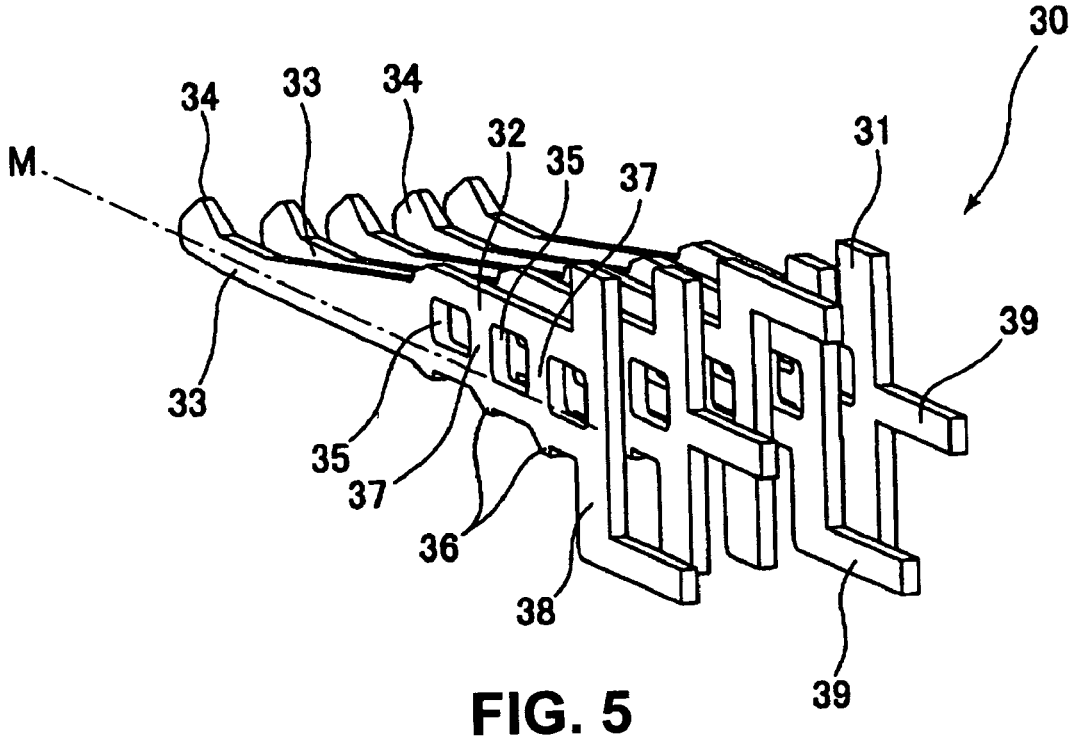
FIG. 5 is an enlarged perspective view of terminals arranged in a housing.

In FIG. 5, an enlarged perspective view of the arrangement state of the terminals 30 arranged inside the housing 50 is shown. Among the five terminals, for example, two terminals are provided for data communication, two terminals are provided for spare, and one terminal is provided for grounding. Total five of the terminals 30 are shown as an example, and the number thereof is not limited to a specific number. However, especially for the terminals for data communication, the terminals in an even number are preferable for achieving differential transmission. By using a pair of two terminals, plus noise and minus noise are canceled, and transmission characteristic can be maintained.

Each of the terminals 30 includes a connecting portion 31 as a rear half portion; a fixing portion 32 as a middle portion; and a contact piece 33 as a front half portion. All of the terminals 30 have the fixing portions 32 and the contact pieces 33 having a substantially same size and length, although a slight difference exists.

Each of the connecting portions 31 includes a vertical portion 38 extending in a direction perpendicular to a fitting direction; and the lead fixing portion 39 extending in a direction same as the fitting direction. The lead fixing portions 39 are arranged alternately up and down to increase a vertical distance between the adjacent lead fixing portions and prevent contact (electrical interference) therebetween.

The contact pieces 33 have a pointed shape tapered toward the fitting direction. Contact portions 34 facing upward are provided at distal ends of the contact pieces 33. When the electrical connector 1 is fitted into the receptacle side connector 2 (refer to FIG. 18), the contact portions 34 can contact with contact portions of receptacle side corresponding terminals 102. One contact portion 34 is provided on one terminal. Accordingly, the contact portions 34 function as a so-called one point contact terminal. Especially, the contact piece 33 of each of the terminals 30 has elasticity to be freely movable up and down, so that the contact with the receptor side corresponding terminals 102 becomes smooth and secure. The contact pieces 33 are held in a state of lifting slightly from the housing 50 (a thin wall portion 47 of a terminal supporting member 58).

Each of the fixing portions 32 has a plurality (three in the embodiment) of holes 35 arranged in a substantially one row along an attaching direction of the terminals 30 to the housing 50 at a substantially center portion thereof. The holes 35 are formed in opposing portions of adjacent terminals, so that it is possible to reduce opposing areas between the terminals 30 and capacitance to be generated there between.

By reducing capacitance, it is easy to obtain impedance compatibility and reduce cross talk between the terminals. It is preferred that the holes 35 of each of the terminals 30 are arranged at same positions in the pitch direction to provide large opposing areas between the adjacent terminals as possible.

As indicated by a projected line M in FIG. 5, it is preferred that the contact portions 34 are arranged along the arrangement direction of the plurality of the holes 35 at a height position same as the arrangement position of the holes 35. By arranging the contact portions 34 at such positions, it is expected that the contact portions 34 have greater elasticity due to elasticity generated by the holes 35.

A size of the holes 35 is preferably large from the viewpoint of reducing cross talk. In an actual case, from the viewpoint of an elongated shape of the fixing portions 32, and strength and processability of the terminal, the size is limited. When the plurality of the holes 35 is formed, it is preferred to provide columns 38 between the holes. When the terminals 30 are fitted into the housing 50, a large force is applied to fitting protrusions 36 used for fitting. Accordingly, as shown in FIG. 5, it is preferred to provide the fitting protrusions 36 near base portions of the columns 37 with large strength.

Figure 6:
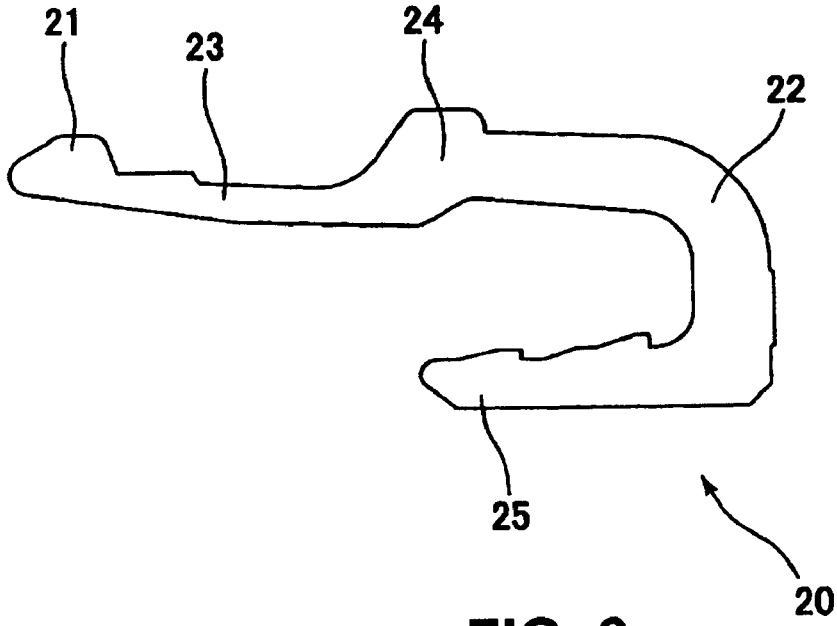
FIG. 6 is a side view of a latch member.

In FIG. 6, a side view of the latch members 20 is shown. Each of the latch members 20 includes a U shaped portion 22 as a main portion at a rear portion thereof; and a front extended portion 23 as a forward extended portion of an upper portion of the U shape. A fitting supporting portion 24 is provided between the front extended portion 23 and the U shaped portion 22 to be fitted into the housing 50 together with a corresponding portion 25 of the U shaped portion 22. A lock piece 21 is provided at a distal end of the front extended portion 23 to be elastically movable up and down through an operation of the U shaped portion 22.

Figure 7:
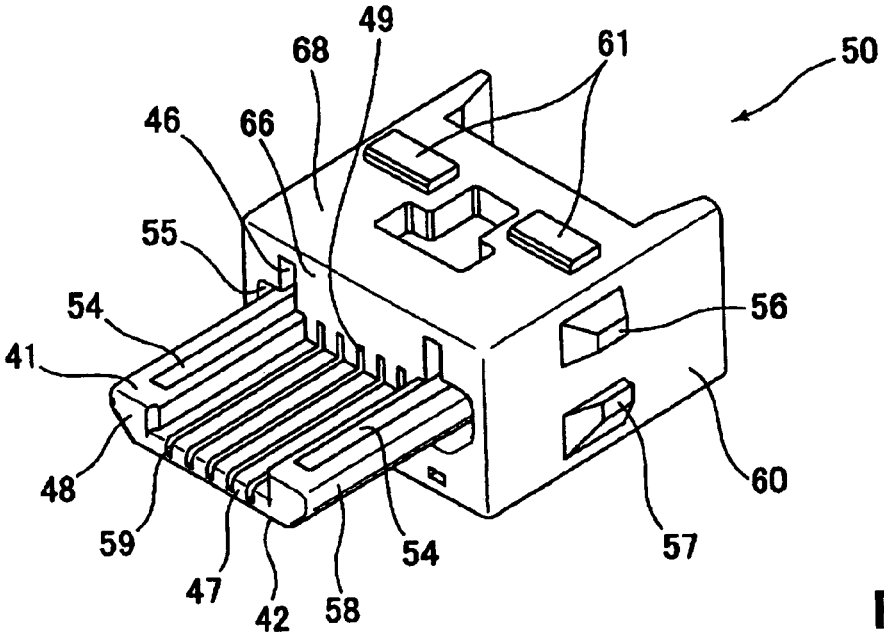
FIG. 7 is a perspective view of the housing.
Figure 8:
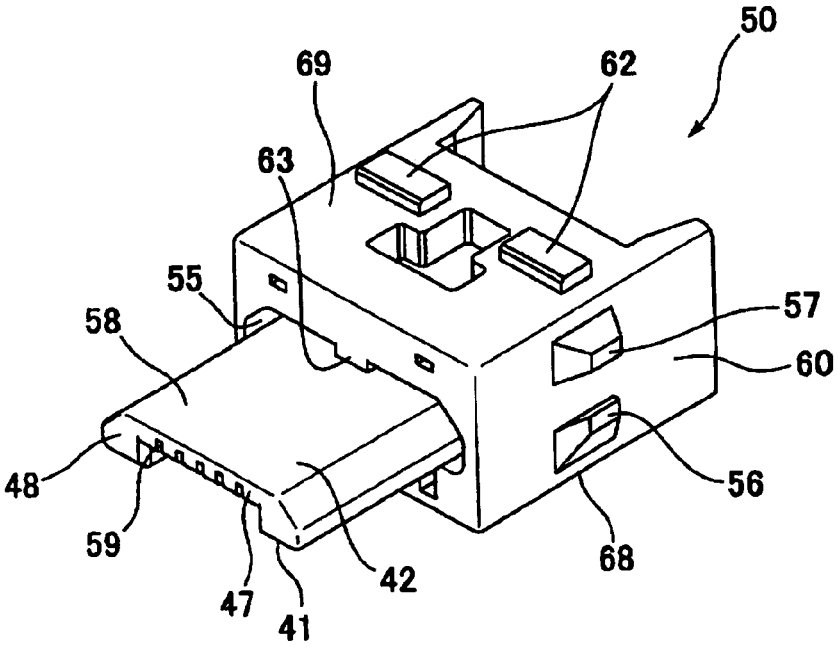
FIG. 8 is a perspective view of the housing.
Figure 9:
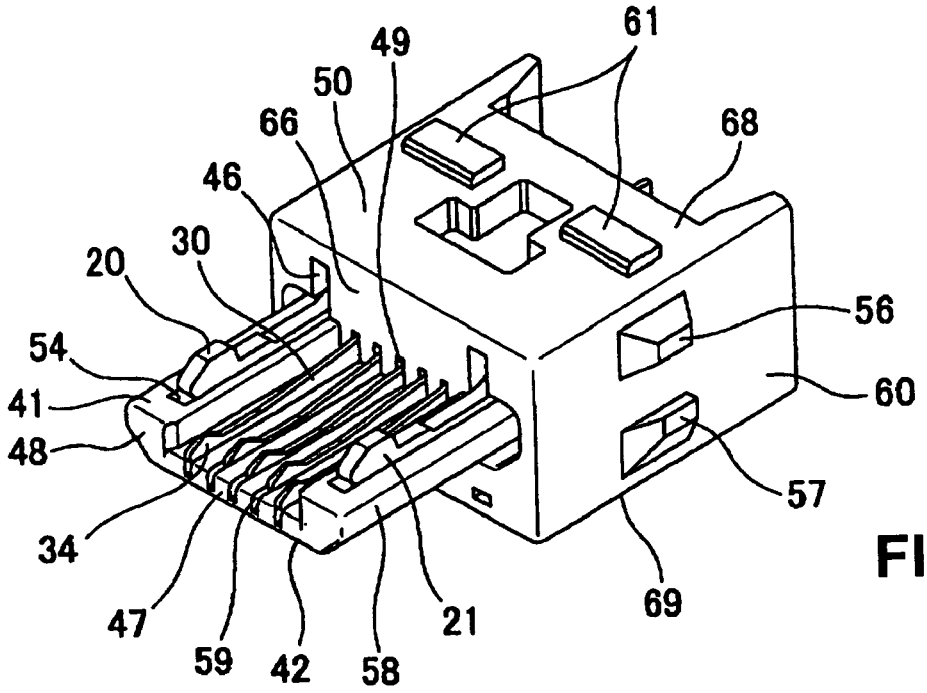
FIG. 9 is a view of the housing shown in FIG. 7 with the latch members and the terminals arranged therein.
Figure 10:
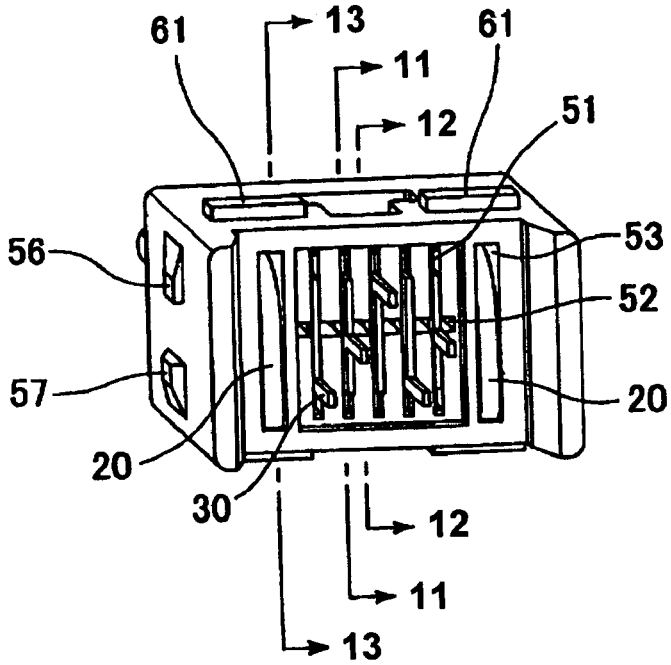
FIG. 10 is a perspective view of the housing.
Figure 11:
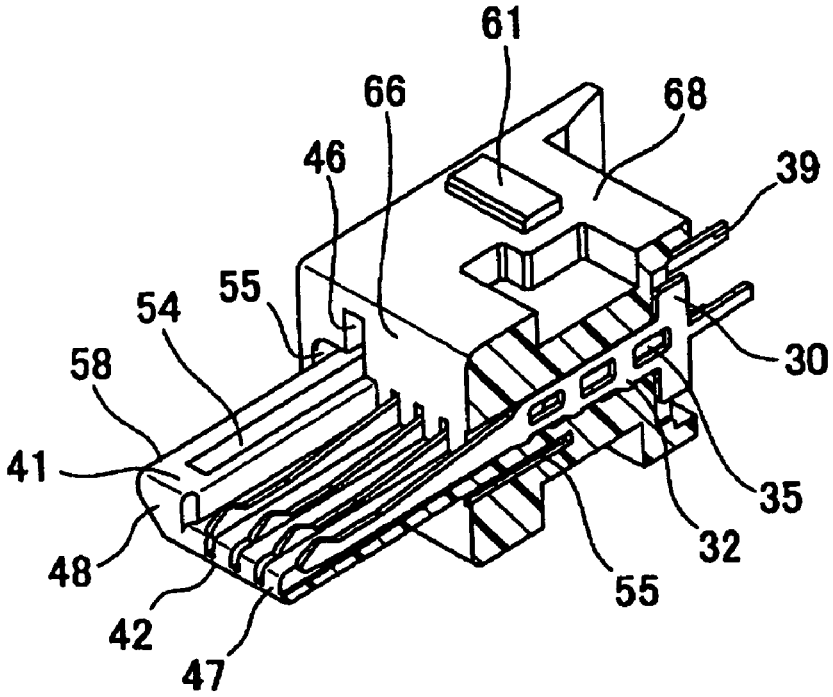
FIG. 11 is a sectional perspective view of the housing taken along a line 11-11 in FIG. 10.
Figure 12:
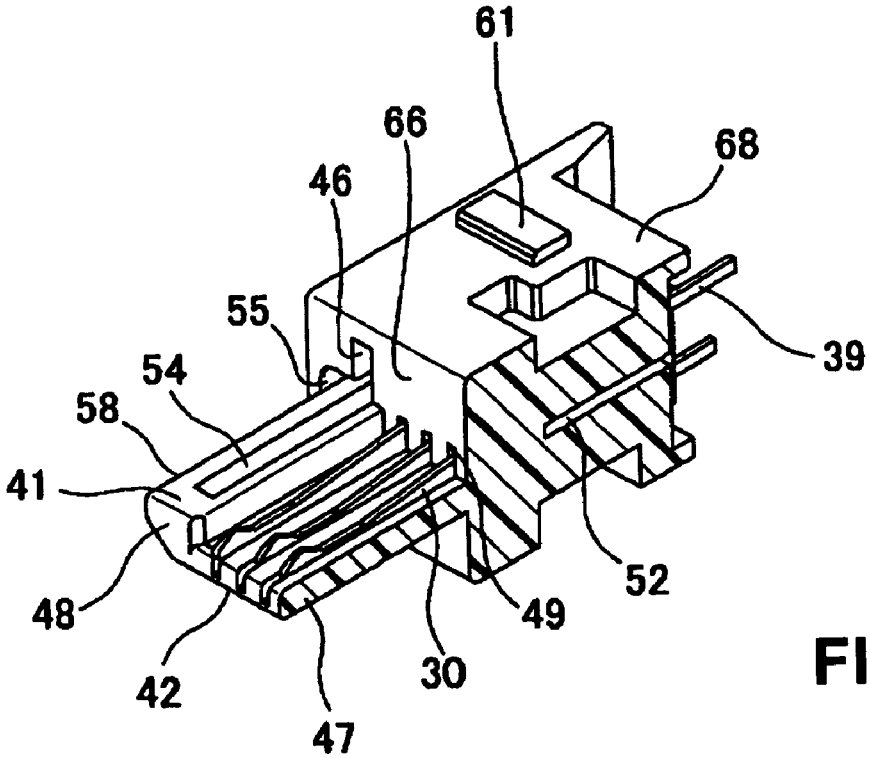
FIG. 12 is a sectional perspective view of the housing taken along a line 12-12 in FIG. 10.
Figure 13:
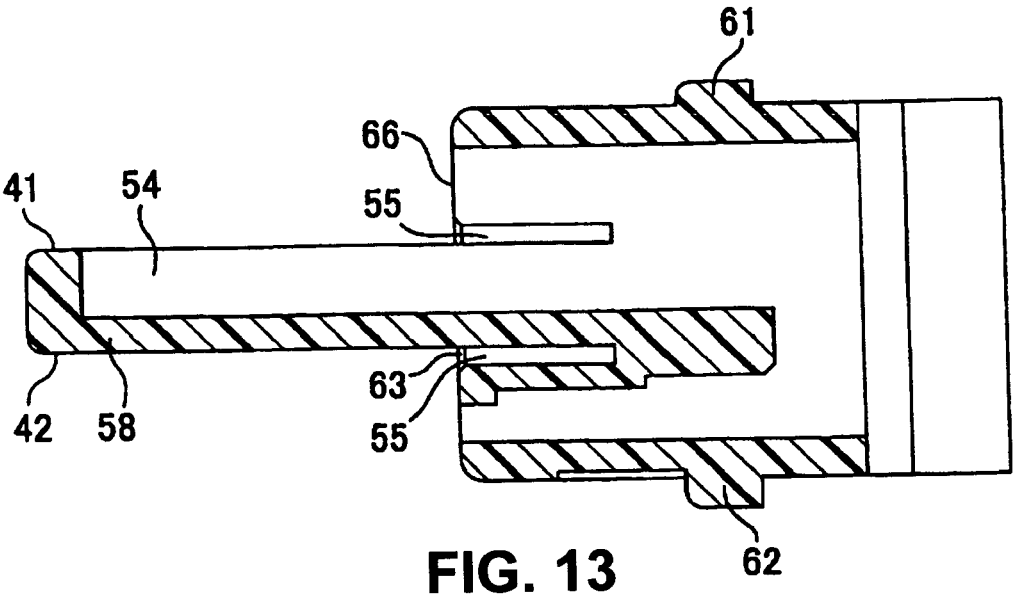
FIG. 13 is a sectional view of the housing taken along a line 13-13 in FIG. 10.

A configuration of the housing 50 will be explained with reference to FIGS. 7 to 13. FIG. 7 is an upper appearance perspective view of the housing 50. FIG. 8 is a lower appearance perspective view thereof. FIG. 9 is a view showing the housing 50 shown in FIG. 7 with the latch members 20 and the terminals 30 arranged therein. FIG. 10 is a backside perspective view of FIG. 9. FIGS. 11 to 13 are a sectional perspective view taken along a line 11-11; a sectional perspective view taken along a line 12-12; and a sectional view taken along a line 13-13 in FIG. 10, respectively.

The housing 50 has the terminal supporting member 58 with a plate shape extending toward the mating connector at a distal end thereof. A space 55 is formed at a base portion of the terminal supporting member 58, and extends toward inside the housing 50 opposite to the extending direction of the terminal supporting member 58. The space 55 is used for holding a part of a base portion of the first shell 70 attached to the housing 50 to increase strength of the terminal supporting member 58.

The space 55 is provided over a whole circumference except an upper front wall surface 66 of the housing 50; portions (46) where the latch members 20 are provided; and a supporting column 63 (refer to FIG. 8) provided at a position opposite to one surface of the terminal supporting member 58 where the latch members 20 and the terminals 30 are provided.

However, the position where the space 55 is provided is not limited thereto. For example, the space 55 may be provided only around circumferences of thick wall portions 48 extending on left and right sides of the terminal supporting member 58 along the extending direction (or opposite direction) of the terminal supporting member 58. Further, the space 55 may be provided in a surface 42 opposite to one surface 41 of the terminal supporting member 58 where the terminals 30 are provided.

Since the space 55 holds a part of the first shell 70, it is possible to increase an area of the terminal supporting member 58 covered with the first shell 70 and increase strength of the terminal supporting member 58. Accordingly, it is possible to reduce a risk of damaging the terminal supporting member 58 due to twist generated upon inserting into and pulling out relative to the mating connector.

The terminals 30 and the latch members 20 are fitted into the housing 50 through vertical holes 51 and vertical holes 53 of the housing 50, respectively. At this time, the contact pieces 33 of the terminals 30 are elastically held along terminal grooves 59 of the thin wall portion 47 of the terminal supporting member 58 in a state that upper half portions of the contact pieces 33 and the contact portions 34 are exposed through terminal holes 49 communicating with the vertical holes 51.

Similarly, the latch members 20 are elastically held along grooves 54 formed in the thick wall portions 48 of the terminal supporting member 58 in a state that substantially upper half portions of the front extended portion 23 and the lock pieces 21 are exposed through lock holes 46 communicating with the vertical holes 53. When fitted into the receptacle side connector (refer to FIG. 18), the latch members 20 engage corresponding latch portions of the mating connector using the lock pieces 21 capable of elastic deformation, so that the electrical connector 1 can be locked with the mating connector.

As shown in the sections in FIGS. 11 and 12, a lateral groove 52 is formed to bridge over the plurality of the terminals 30 near positions of the housing 50 where the fixing portions 32 of the terminals 30 are arranged for forming spaces between the adjacent terminals 30. By providing the lateral groove 52, it is possible to reduce dielectric constant between the adjacent terminals and reduce cross talk between the terminals. By providing the space 52 at a height position same as that of the holes 35 in the pitch direction, it is possible to effectively reduce cross talk.

It is preferred that the lateral groove 52 is made large as possible for reducing cross talk. However, in an actual case, it is necessary to determine the size according to strength and processability of the terminals.

Figure 14:
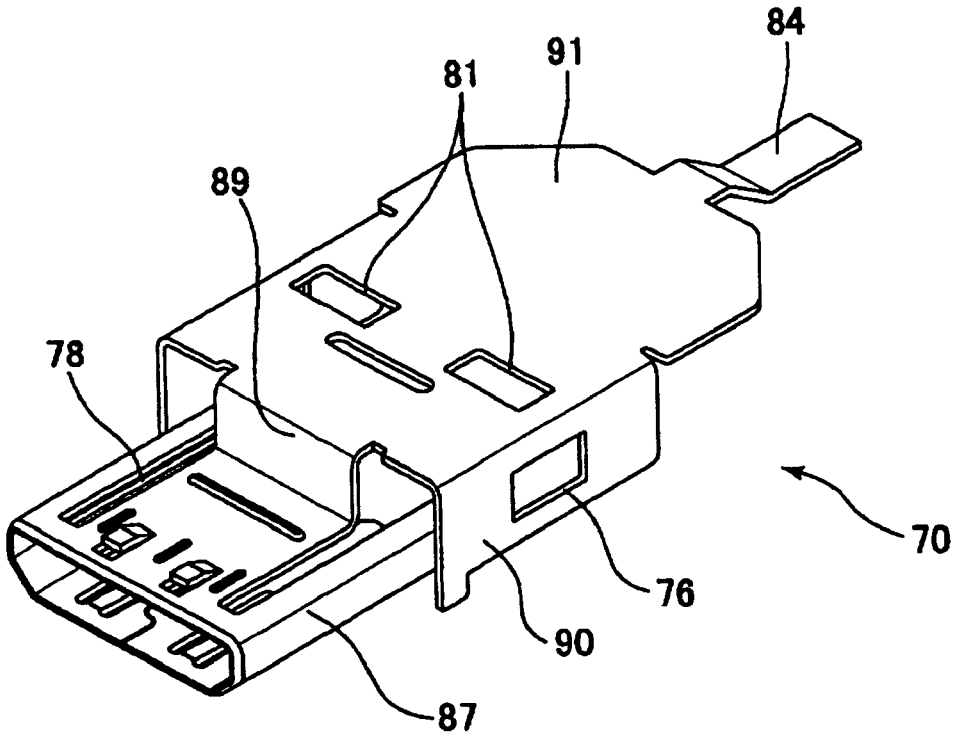
FIG. 14 is a perspective view of a first shell.
Figure 15:
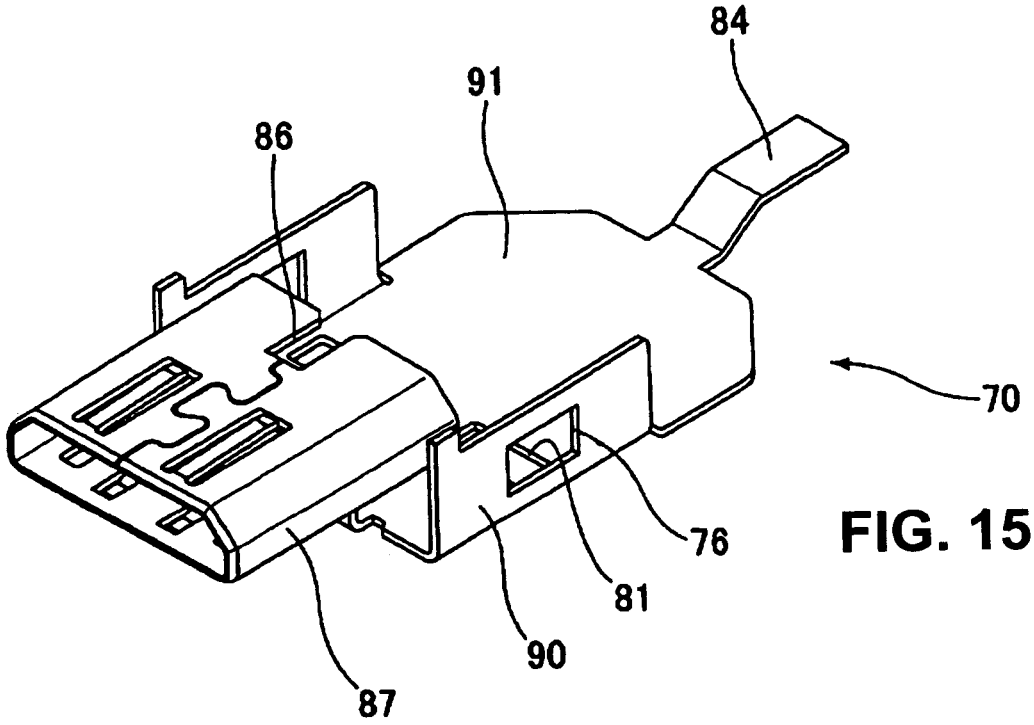
FIG. 15 is a perspective view of the first shell.
Figure 16:
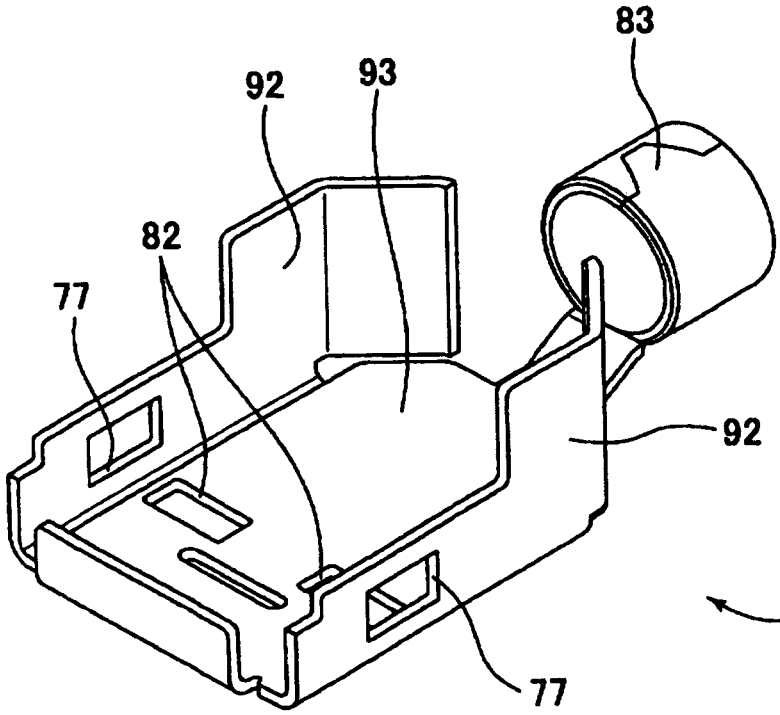
FIG. 16 is a perspective view of a second shell.
Figure 17:
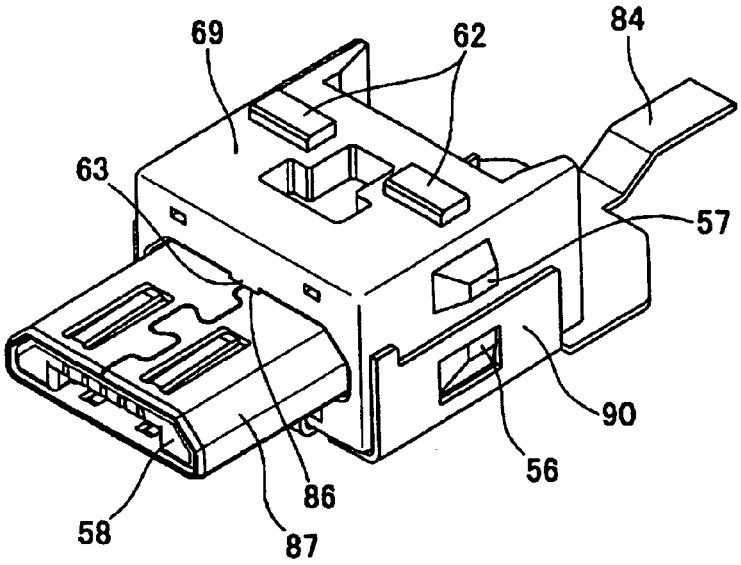
FIG. 17 is a view of the first shell attached to the housing.

Configurations of the first shell 70 and the second shell 72 will be explained with reference to FIGS. 14 to 17. FIG. 14 is an upper surface perspective view of the first shell 70, and FIG. 15 is a rear surface perspective view thereof. FIG. 16 is an upper surface perspective view of the second shell 72. FIG. 17 is a view showing a state that the first shell 70 is attached to the housing 50.

The first shell 70 can be formed through punching through and bending one thin metal plate. Accordingly, it is easy to produce the first shell 70. The first shell 70 mainly includes a cylindrical portion 87 for covering the terminal supporting member 58 along the extending direction thereof; a bent portion 89 for covering an upper front wall surface 66 of the housing 50 from front; an upper wall 91 for covering the upper surface 68 of the housing 50; and sidewalls 90 for covering an upper half of side surfaces 60 of the housing 50.

When the first shell 70 is attached to the housing 50, a base portion of the cylindrical portion 87 is inserted into the space 55 of the housing 50 and held there. The cylindrical portion 87 has slits 78 opened at the base portion of the cylindrical portion 87 and closed at a front portion thereof for allowing the latch members 20 to be attached. Also, the cylindrical portion 87 has a cut portion 86 for avoiding collision with the supporting column 63 of the housing 50 when the first shell 70 is attached to the housing 50 (refer to FIG. 17).

When the first shell 70 is attached to the housing 50, engaging holes 76 formed in the sidewalls 90 engage engaging protrusions 56 formed on the side surfaces 60 of the housing 50, and an engaging hole 81 formed in the upper wall 91 engages an engaging protrusion 61 formed on the upper surface 68 of the housing 50. Accordingly, the first shell 70 engages the housing 50. At this time, the cylindrical portion 87 of the first shell 70 covers around the circumference of the terminal supporting member 58.

Similar to the first shell 70, the second shell 72 also can be formed through punching through and bending one thin metal plate. A circular portion 83 is provided at a rear end of the second shell 72 for holding the cable. A main body portion of the second shell 72 has a shape corresponding to that of the first shell 70.

When the first shell 70 and the second shell 72 are assembled together, they cover the terminal supporting member 58 and the side surface circumferences and the rear end side of the housing 50. When the second shell 72 is attached to the housing 50, engaging holes 77 formed in the sidewalls 90 engage engaging protrusions 57 formed on the side surfaces 60 of the housing 50, and an engaging hole 82 formed in the bottom wall 93 engages an engaging protrusion 62 formed on the bottom surface 69 of the housing 50. Accordingly, the second shell 72 engages the housing 50.

Figure 18:
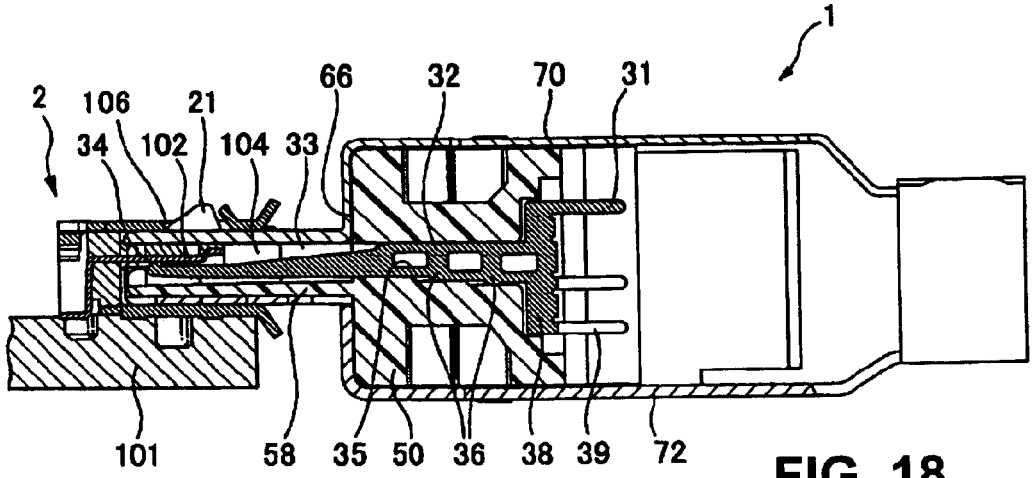
FIG. 18 is a sectional view of the electrical connector in a state connected to a receptacle side connector.
Figure 19:
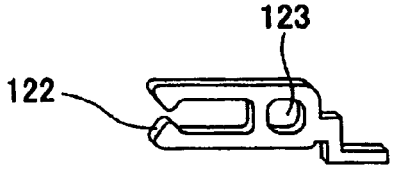
FIG. 19 PRIOR ART
FIG. 19 is a view of a conventional electrical connector.

FIG. 18 shows a connection state of the electrical connector (plug side connector) 1 of the present invention and the receptacle side connector 2. The receptacle side connector 2 may be fixed to, for example, an edge of the substrate 101. When the distal end of the terminal supporting member 58 covered around with the first shell 70 of the electrical connector 1 as the plug side connector is inserted into a insertion portion 104 of the receptacle side connector 2, the contact portions 34 on the side of the electrical connector 1 contact with contact pieces 102 on the side of the receptacle side connector 2. Also, the lock pieces 21 on the side of the electrical connector 1 engage engaging holes 106 on the side of the receptacle side connector 2, thereby locking the electrical connector 1 to the receptacle side connector 2.

In the present invention, various modifications are possible. For example, the positions, size, number, and the likes of the holes 35 are not limited to those shown in FIG. 5. One terminal may have a plurality of holes in a height direction, or not only the height direction, but may have a plurality of holes in the fitting direction, or may have a plurality of holes in the height direction and the fitting direction. Alternatively, the holes may be arranged alternately in the height direction and/or the fitting direction. Alternatively, a size of the holes may be decreased to increase the number thereof. Further, the holes may be arranged alternately in the pitch direction with respect to the adjacent terminals.

The electrical connector of the present invention is widely applicable to small electronic and electrical devices.

While the invention has been explained with reference to the specific embodiments of the invention, the explanation is illustrative and the invention is limited only by the appended claims.

What is claimed is:

1. An electrical connector comprising:

a housing; and a plurality of terminals fitted into the housing, each of said terminals having a connecting portion, a fixing portion, and a contact piece, said fixing portion having a plurality of columns, a plurality of holes between the columns, and a fitting protrusion at a base portion of at least one of the columns, said holes being formed in an opposing surface of the fixing portion facing an adjacent terminal.

2. The electrical connector according to claim 1, wherein said terminals have a plate shape.

3. The electrical connector according to claim 1, wherein each of said terminals includes the hole arranged such that areas of the opposing surfaces between the terminals are reduced.

4. The electrical connector according to claim 1, wherein each of said terminals includes the holes arranged at a first position and the housing has a groove arranged at a second position same level as that of the first position.

5. The electrical connector according to claim 1, wherein each of said terminals includes the holes arranged substantially in one row along a fitting direction that the terminals are fitted into to the housing.

6. The electrical connector according to claim 1, wherein each of said terminals includes a contact portion at a distal end thereof for contacting with a contact portion of a mating terminal.

7. The electrical connector according to claim 6, wherein said contact portion is situated along a fitting direction that the terminals are fitted into to the housing.

8. The electrical connector according to claims 1, wherein said housing further includes a terminal supporting member for arranging the terminals.

9. The electrical connector according to claim 8, wherein said contact piece is arranged apart from the terminal supporting member.

10. The electrical connector according to claim 8, wherein the terminal supporting member has a plate shape.

11. The electrical connector according to claim 1, wherein said connecting portion includes a lead fixing portion to be fixed to a lead of a cable.

12. The electrical connector according to claim 11, wherein said lead fixing portion is situated at one of upper, middle, and lower positions different from that of the adjacent terminal so that the lead fixing portions a4re alternately situated at the upper, middle, and lower positions.

13. The electrical connector according to claim 1, wherein said contact piece has a width decreasing toward a distal end thereof and includes one contact portion for contacting a contact portion of a mating terminal through one single contact route.

* * * * *